US011330921B2

(12) United States Patent
Bice

(10) Patent No.: US 11,330,921 B2
(45) Date of Patent: May 17, 2022

(54) PILLOW

(71) Applicant: Kimberlee M. Bice, Midland, TX (US)

(72) Inventor: Kimberlee M. Bice, Midland, TX (US)

(73) Assignee: Kimberlee M. Bice, Midland, TX (US)

( * ) Notice: Subject to any disclaimer, the term of this patent is extended or adjusted under 35 U.S.C. 154(b) by 0 days.

(21) Appl. No.: 16/211,044

(22) Filed: Dec. 5, 2018

(65) Prior Publication Data

US 2019/0167020 A1 Jun. 6, 2019

Related U.S. Application Data

(60) Provisional application No. 62/594,996, filed on Dec. 5, 2017.

(51) Int. Cl.
*A47G 9/10* (2006.01)
*A47C 7/38* (2006.01)

(52) U.S. Cl.
CPC ..... *A47G 9/1081* (2013.01); *A47C 7/383* (2013.01); *A47G 9/10* (2013.01); *A47G 2200/106* (2013.01)

(58) Field of Classification Search
CPC ..... A47G 9/1081; A47G 9/10; A47G 2200/106; A47C 7/383
See application file for complete search history.

(56) References Cited

U.S. PATENT DOCUMENTS 2,765,480 A * 10/1956 Mueller ..... A47G 9/10 5/640
2,952,856 A * 9/1960 Ruff ..... A47G 9/10 5/640
3,897,777 A * 8/1975 Morrison ..... A61F 5/05883 5/622
4,031,578 A * 6/1977 Sweeney ..... A47C 7/383 5/426
D257,200 S 10/1980 LaRocca
4,345,345 A * 8/1982 Holtz ..... A47C 7/383 5/640
4,506,396 A * 3/1985 Ritchie, Jr ..... A47C 20/023 5/631
4,528,981 A * 7/1985 Behar ..... A61F 5/055 5/637
D309,393 S 7/1990 Talaugon
5,305,754 A * 4/1994 Honeywell ..... A61F 5/05883 128/870
5,864,904 A * 2/1999 Rudick ..... A47G 9/10 5/490

(Continued)

OTHER PUBLICATIONS

International Search Report and Written Opinion from PCT/US2018/064129, dated Feb. 14, 2019.

*Primary Examiner* — Robert G Santos
*Assistant Examiner* — Rahib T Zaman
(74) *Attorney, Agent, or Firm* — Maschoff Brennan

(57) ABSTRACT

A pillow may include a first arm and a second arm, and a connecting portion may be connected to the first arm and the second arm. The connecting portion may be sized and configured to allow the first arm and second arm to move independently. For example, the first arm may be rotatable relative to the connecting portion by at least about 30°, at least about 45°, at least about 60°, at least about 75°, at least about 90°, or more. The second arm may be rotatable relative to the connecting portion by at least about 30°, at least about 45°, at least about 60°, at least about 75°, at least about 90°, or more.

20 Claims, 10 Drawing Sheets

(56) References Cited

U.S. PATENT DOCUMENTS

D417,997 S 12/1999 Yannakis
6,347,421 B1 * 2/2002 D'Emilio ..... A47C 7/383 297/391
6,484,337 B1 * 11/2002 Moe ..... A47C 7/021 5/652
6,560,800 B1 * 5/2003 Draves ..... A47C 20/023 5/630
6,581,227 B1 * 6/2003 Obermaier ..... A47C 7/024 5/654
6,641,220 B2 * 11/2003 Clegg ..... A47C 7/383 297/397
D494,128 S 8/2004 Berger
6,795,990 B1 * 9/2004 Hutchinson D. C. ..... A47C 20/021 5/490
6,804,845 B2 * 10/2004 Stewart, III ..... A61G 7/07 5/632
6,817,049 B1 * 11/2004 Hall ..... A47G 9/10 5/636
D547,586 S 7/2007 Weiss-Lohrei
D628,004 S 11/2010 Moorefield
7,975,336 B1 * 7/2011 Perry ..... A47C 20/027 5/636
D655,964 S 3/2012 Dror
8,419,128 B1 * 4/2013 Leach ..... B60N 2/2881 297/219.12
9,021,635 B1 * 5/2015 Leach ..... A47C 20/02 5/630
D747,614 S 1/2016 Meenan
9,560,915 B2 * 2/2017 Graller ..... A47C 7/021
D807,665 S 1/2018 Vega-Woller et al.
D835,431 S 12/2018 Bice
2006/0031992 A1 * 2/2006 Moore ..... A47C 20/021 5/630
2012/0017375 A1 * 1/2012 Weibel ..... A47C 7/021 5/653
2012/0124749 A1 * 5/2012 Lewman ..... A47C 15/004 5/653
2016/0128500 A1 * 5/2016 Yuyungyuen ..... A47G 9/1054 5/632

* cited by examiner

PILLOW

BACKGROUND

Field

The present disclosure generally relates to pillows and, in particular, to pillows that may provide one or more functions.

Background

Traditional pillows, when used to support the neck and head, typically force the head upward or forward due to the stuffed, rounded shape of the pillow. Forcing the head upward or forward may lead a user to experience discomfort in the head, neck, or shoulder regions.

Conventional pillows may be uncomfortable to use because the pillow may provide insufficient cushioning. In order to increase cushioning, materials that are more compressible have been used but these materials have a tendency to deform or distort. Materials that are more compressible may also have a tendency to settle or be matted down.

Known pillows may also have a shape that makes the pillows uncomfortable to use in certain conditions. For example, known pillows may have a desired shape when the pillow is being used in one position, but the pillow may have an undesirable shape when the pillow is being used in a different position. In addition, some known pillows may be awkward to use because the shape of the pillow may limit potential uses of the pillow. For example, a traditional pillow may have a rectangular shape and it may be useful for sleeping or resting in one position, such as while lying down, but it may be difficult to use while in another position, such as while sitting or traveling. In addition, the size of many known pillows may limit their usefulness. For example, the large size of a traditional pillow may make the pillow convenient to use for some activities but may make the pillow inconvenient to use in other activities. Similarly, known pillows with a small size may be useful in some circumstances but may not be useful in other circumstances.

BRIEF SUMMARY OF THE INVENTION

A need therefore exists for a pillow that eliminates the above-described disadvantages and problems.

One aspect is a pillow that may support a user's head without forcing the head upwards or forwards. For example, the pillow may contain first and second portions that support one or both the sides of the head and/or neck of the user. A connecting portion, such as a third portion, may connect the first and second portions. In one exemplary embodiment, the first and second portions of the pillow may have generally the same shape, size, configuration, and/or arrangement. For instance, the first and second portions of the pillow may have a generally cylindrical shape and these portions may be sized and shaped to support the sides of the head and/or neck of the user. In particular, the first and second portions may have a length and a diameter that allows the pillow to support the sides of the head and/or neck. The first and second portions, for example, could have a shape, size, and configuration that allow the pillow to contact an upper portion of the user's shoulders. This may allow the pillow to rest on the shoulders of the user, if desired.

Advantageously, if the first and second portions of the pillow have generally the same shape, size, configuration, and/or arrangement, that may increase the versatility of the pillow. For example, the first and second portions of the pillow may have generally symmetrical shapes and that may allow the pillow to be readily used in various positions such as upwardly and/or downwardly facing. Significantly, if the first and second portions of the pillow are generally the same, then the first and second portions may be interchangeably used. For instance, the first and/or second portions of the pillow may be used to support the left and/or right sides of the user's head and/or neck. If the first and second portions of the pillow have generally symmetrical shapes, that may increase the potential uses of the pillow. In addition, if the first and second portions of the pillow have generally symmetrical shapes, then the ease of use of the pillow may be increased because, for instance, the pillow may be orientated in different positions and still perform the same or related functions.

The size of the first and second portions of the pillow may change depending, for example, upon the intended use of the pillow. For example, the diameter of the first and second portions of the pillow may be larger for adult-sized pillows than for child-sized pillows. The diameter of the first and second portions of the pillow may also be larger for males than females. For example, the first and second portions of an adult-sized pillow may have an outer diameter of approximately four (4) inches and a length of about nine (9) inches. The first and second portions of a child-sized pillow may have an outer diameter of about three (3) inches and a length of about six and one-half (6.5) inches. The connecting portion of the adult and child-sized pillow may be about two and one-half (2.5) inches. After reviewing this disclosure, one skilled in the art will appreciate that the various components of the pillow may have different shapes, sizes, configurations and arrangements depending, for example, upon the intended use of the pillow. For example, the adult-sized pillow may have an outer diameter of about four and one-half (4.5) inches, about five (5) inches, about five and one-half (5.5) inches, about six (6) inches, about six and one-half (6.5) inches, or more. The adult-size pillow may have a length that is less than about nine (9) inches, such as about eight (8) inches, about seven (7) inches, about six (6) inches, about five (5) inches, or less. The adult-size pillow may also have a length that is greater than about nine (9) inches, such as about ten (10) inches, about eleven (11) inches, about twelve (12) inches, about thirteen (13) inches or more. The child-sized pillow may have an outer diameter that is larger or smaller than about three (3) inches, such as about one (1) inch, about one and one-half (1.5) inches, about two (2) inches, about two and one-half (2.5) inches, about three and one-half (3.5) inches, or about four (4) inches. The child-size pillow may have a length that is less than about six and one-half (6.5) inches, such as about six (6) inches, about five (5) inches, about four (4) inches, about three (3) inches, or less. The child-size pillow may have a length that is greater than about six and one-half (6.5) inches, such as about seven (7) inches, about eight (8) inches, about nine (9) inches, or more. The connecting portion of the adult and child-sized pillow may be larger or small than about two and one-half (2.5) inches depending, for example, upon the size of the first and second portions. For instance, the connecting portion could be smaller, such as about two (2) inches, about one and one-half (1.5) inches, about one (1) inch, or less, or the connecting portion could be larger, such as about three (3) inches, three and one-half (3.5) inches, about four (4) inches, or more. It will be appreciated, after reviewing this disclosure, that the first portion, the second portion, and/or the connecting portion could have other suitable shapes, sizes, configurations, and/ or arrangements depending, for example, upon the intended use of the pillow. It will further be appreciated, after reviewing this disclosure, that the pillow, or parts of the pillow, can be symmetrical and/or asymmetrical, and the pillow, or parts of the pillow, may be proportionate or disproportionate, depending, for example, upon the intended use of the pillow.

The first and second portions of the pillow may be constructed from relatively firm materials so that the first and second portions of the pillow generally maintain their shape during use. For example, the first and second portions of the pillow may be constructed from relatively firm materials such as foam, memory foam, and the like. The first and second portions of the pillow may also be stuffed with various natural and synthetic materials such as polyester, polyester pellets, microbeads, polystyrene, foam, natural latex rubber, down, feathers, wool, buckwheat, flaxseed, and the like. The type and/or amount of materials may facilitate the first and second portions of the pillow generally maintaining their shape during use. The type and/or amount of materials may also allow the first and second portions of the pillows to deform and/or resiliently deform during use.

Another aspect is a pillow that may include first and second portions that are connected by a connecting portion and the connecting portion may be relatively thin, relatively flat and/or have a relatively small thickness. For example, while the first and second portions of the pillow may be sized and configured to support the sides and/or neck of the user, the connecting portion may provide only some support and/or cushioning. Advantageously, because the connecting portion may have a relatively small thickness, such as generally equal to or less than about 1.0 inch, about 0.75 inches, about 5 inches, about 0.25 inches, or less, the connecting portion may not push the head of the user upwardly or forwardly during use. In an exemplary embodiment, the connecting portion may provide cushioning to the back of the user's head and/or neck, but the thickness of the connecting portion may be such that the user's head and/or neck is not pushed upwardly when the user is in a generally horizontal or prone position, such as when laying on the user's back. The connecting portion may also not push the user's head or neck forwardly when the user is in an upright or sitting position. The pillow may be significantly more comfortable to use because the pillow may not push the user's head upwardly or forwardly. The connecting portion may also have a relatively flatter or less curved outer surface that the first and/or second portions. Thus, for example, the first and/or second portions may have an outer radius of curvature that is much larger than an outer radius of curvature of the connecting portion. In an exemplary embodiment, the outer radius of curvature of the first and/or second portions may be at least two, three, four, five, or more times the radius of curvature of the connecting portion. In another exemplary embodiment, the first and second portions may have a thickness at least two, three, four, five, or more times the thickness of the connecting portion.

Still another aspect is a pillow may include a closure and the closure may help maintain the pillow in a desired configuration or arrangement. For example, the connecting portion may be connected to an end of the first and second portions of the pillow and the closure may be connected to the other end of the first and second portions of the pillow. The closure may allow the pillow to remain in a generally U-shaped configuration or arrangement. For instance, during use of the pillow, the first and second portions of the pillow may be disposed along the sides of the user's head and/or neck, and the connecting portion may be disposed at least proximate the back of the user's head and/or neck. In this configuration, the pillow may have a generally U-shaped arrangement. The closure may help maintain the pillow in the generally U-shaped arrangement and the closure may attach the pillow the user and/or help maintain the pillow in generally the same position relative to the user. In an exemplary embodiment, the closure may be adjustable in length. For example, the closure may include a first section attached to the first portion of the pillow and a second section attached to the second portion of the pillow. The first and second sections of the closure may be connected by tying, snaps, buttons, hook-and-loop fasteners, and the like. While the closure is preferably adjustable in length, one skilled in the art will appreciate after reviewing this disclosure that the closure does not have to be adjustable in length and the closure could have other suitable structures, configurations, and arrangements depending, for example, upon the intended use of the pillow.

Yet another aspect is a pillow that may support the head of the user while the user is laying down without pushing the user's head upwardly or forwardly. For example, the first and second sides of the pillow may provide lateral support that helps prevent the head from moving to one or both sides. That is, the first and second sides of the pillow may help prevent unintended movement or rotation of the user's head.

Still yet another aspect is a pillow that may support the head of the user without pushing the user's head forwardly when the user is in an upright or sitting position. The first and second sides of the pillow may support one or both sides of the head of the user and the thin connecting portion may not push the user's head and/or neck forwardly. Thus, the pillow may provide lateral support to the head of the user without pushing the user's head forwardly, which may increase the comfort of the user. In addition, the closure may help maintain the pillow in the desired position. The pillow may therefore provide increased comfort to the user, for example while traveling, because lateral support can be provided to one or both sides of the user's head without uncomfortably pushing the user's head forwardly.

A further aspect is a pillow that may have one or more different configurations or arrangements. For example, the pillow may be disposed in a generally U-shaped configuration with a first portion disposed along a first side of a user's head and/or neck, a second portion disposed along a second side of the user's head and/or neck, and a connecting portion connecting the first and second portions. In an exemplary embodiment, the connecting portion may be flexible or bendable. In addition, or alternatively, one or more of the connections between the first and second portions and the connection portion may be flexible or bendable. For example, the connecting portion and/or the one or more of the connections between the first and second portions may also provide hinge-like features. This may allow, for instance, the pillow to be disposed in different configurations and arrangements such in a generally L-shaped or angled configuration. In greater detail, the connection between the first portion and the connecting portion and/or the connection between the second portion and the connecting portion may be flexible or bendable to allow the first and second portions of the pillow to be disposed at an angle such as about 90°, about 75°, about 60°, about 45°, about 30°, and/or about 15°. Advantageously, the pillow may be disposed at a variety of suitable angles depending, for example, upon the intended use of the pillow.

Another further aspect is a pillow that may include one or more flexible connections and the flexible connections may allow the pillow to be disposed in various configurations and arrangements. The flexible connections may allow the pillow to be easily manipulated into different configurations and the connections may allow the pillow to maintain the desired shape. The flexible connections could also be elastic, resilient, and/or biased, if desired. The flexible connections may allow the pillow to be used for different functions and purposes.

Still another further aspect is a pillow that may be disposed in multiple different configurations, which may allow the pillow to be used for different purposes. For example, the pillow may be sized and configured to support both sides of the head of the user in upright, angled, or prone positions. In this exemplary configuration, the pillow may be disposed about the head and/or neck of the user and the pillow may have a generally U-shaped configuration. The pillow may also be sized and configured to support one side of the head or neck of the user. In this exemplary configuration, the pillow may have an L-shaped or angled configuration. The first and second portions of the pillow could be disposed at an angle, such as about 30°, about 60°, about 90°, about 120°, about 150° or more, in the angled configuration. The pillow may also include one or more portions that are generally aligned along an axis. For instance, the first portion, the second portion, and the connecting portion of the pillow may be generally aligned along an axis. In this exemplary configuration, the pillow may extend along a generally straight line. In other exemplary configurations, the first section and the connecting portion of the pillow may be aligned and/or the second section and the connecting portion of the pillow may be aligned. Further, in another exemplary configuration, the first and second portions of the pillow may be disposed in a generally parallel configuration. In the generally parallel configuration, the first and second portions of the pillow may be spaced apart by a distance and/or may contact or touch.

Yet another further aspect is a pillow that may provide one or more functions. For example, the pillow may be sized and configured to support one or both sides of the user's head and/or neck. In another exemplary embodiment, the pillow may support the user's back. For instance, all or a portion of the pillow may be used to support the user's lower back. Thus, for example, the first or second portion of the pillow may be used to support the user's lower back, or the first and second portions of the pillow may be used to support the user's lower back. The pillow may be disposed in a straight line, angled, U-shaped or parallel configurations depending, for example, upon how the user desires to use the pillow to support his or her back. In yet another exemplary embodiment, the pillow may support the legs of the user. For instance, the pillow may be placed under the user's knees or ankles and the pillow may be disposed in a straight line, angled, U-shaped or parallel configuration depending, for example, upon how the user desires to support his or her legs. Thus, the pillow may support different portions of the body. It will also be appreciated that the pillow may support other portions of the body such as the arms, core region, etc.

Still yet another aspect is pillow that may be designed for use while traveling and at home. For example, the pillow may be used while traveling by plane, train, automobile, etc. In particular, the pillow may facilitate sleeping and/or resting while traveling because the pillow may provide head and/or neck support in an upright or sitting position without causing the head or neck to be placed in an awkward position. For instance, the pillow may support the head and/or neck while keeping the head and neck generally aligned with the user's spine and without pushing the user's head or neck forwardly into an uncomfortable position. The pillow may also provide lumbar support while traveling by placing all or a portion of the pillow between the user's lower back and the back of a chair. The pillow can also be used at home while watching television, reading, and the like.

Advantageously, the multi-functionality of the pillow may allow the user to alter the shape of the pillow to best accommodate and support various body parts. In addition, the multifunctional pillow may remove stress or discomfort experienced from a typical pillow that forces the user's head forward.

These and other aspects, features, and advantages of the present invention will become more fully apparent from the following brief description of the drawings, the drawings, the detailed description of exemplary embodiments, and appended claims.

BRIEF DESCRIPTION OF THE DRAWINGS

The appended drawings contain figures of preferred embodiments to further illustrate and clarify the above and other aspects, advantages, and features of the present invention. It will be appreciated that these drawings depict only preferred embodiments of the invention and are not intended to limit its scope. Additionally, it will be appreciated that while the drawings may illustrate preferred sizes, scales, relationships, and configurations of the invention, the drawings are not intended to limit the scope of the claimed invention. The invention will be described and explained with additional specificity and detail through the use of the accompanying drawings in which:

DETAILED DESCRIPTION OF EXEMPLARY EMBODIMENTS

The present invention is generally directed towards a pillow. The principles of the present invention, however, are not limited to pillows. Additionally, to assist in the description of the pillow, words such as top, bottom, front, rear, right and left are used to describe the accompanying figures. It will be appreciated, however, that the pillow can be located in a variety of desired positions or orientations, including various angles, sideways, and even upside down.

The pillow shown in the accompanying figures and described in more detail below, which are exemplary embodiments of the pillow, may support various portions of the user's body. In addition, the pillow may be used in various environments and locations, such as at home or while traveling.

The pillow shown in the accompanying figures may be to scale and/or one or more parts or components of the pillow shown in the accompanying figures may be to scale. The drawings, however, are not necessarily to scale. Thus, while the pillow shown in the accompanying figures may illustrate exemplary shapes, sizes, configurations, and/or arrangements, and these exemplary shapes, sizes, configurations, and/or arrangements may be to scale, the pillow may have other appreciate shapes, sizes, configurations, and/or arrangements depending, for example, upon the intended use of the pillow.

One of ordinary skill in the art, after reviewing this disclosure, will understand that the pillow may have a variety of shapes, sizes, configurations, and arrangements depending, for example, upon the intended use of the pillow. One of ordinary skill in the art, after reviewing this disclosure, will also understand that the pillow may include any suitable number and combination of features, components, aspects, and the like. Additionally, while the pillow illustrated in the accompanying figures may have particular structures, styles, and configurations, it will be appreciated that the pillow may have a variety of suitable structures, styles, and configurations. Further, while the accompanying drawings may be to scale and may show the relationship between various parts and components, the pillow may have other shapes, sizes, configurations, and arrangements.

One of ordinary skill in the art, after reviewing this disclosure, will understand that different embodiments may have one or more different parts, components, features, and aspects. Further, these different parts, components, features, and aspects may not be required in different embodiments. Additionally, it will be understood that different embodiments may include various combination of these parts, components, features, and aspects, varying upon the intended use of the pillow. A detailed description of exemplary embodiments of the pillow now follows.

Figure 1:
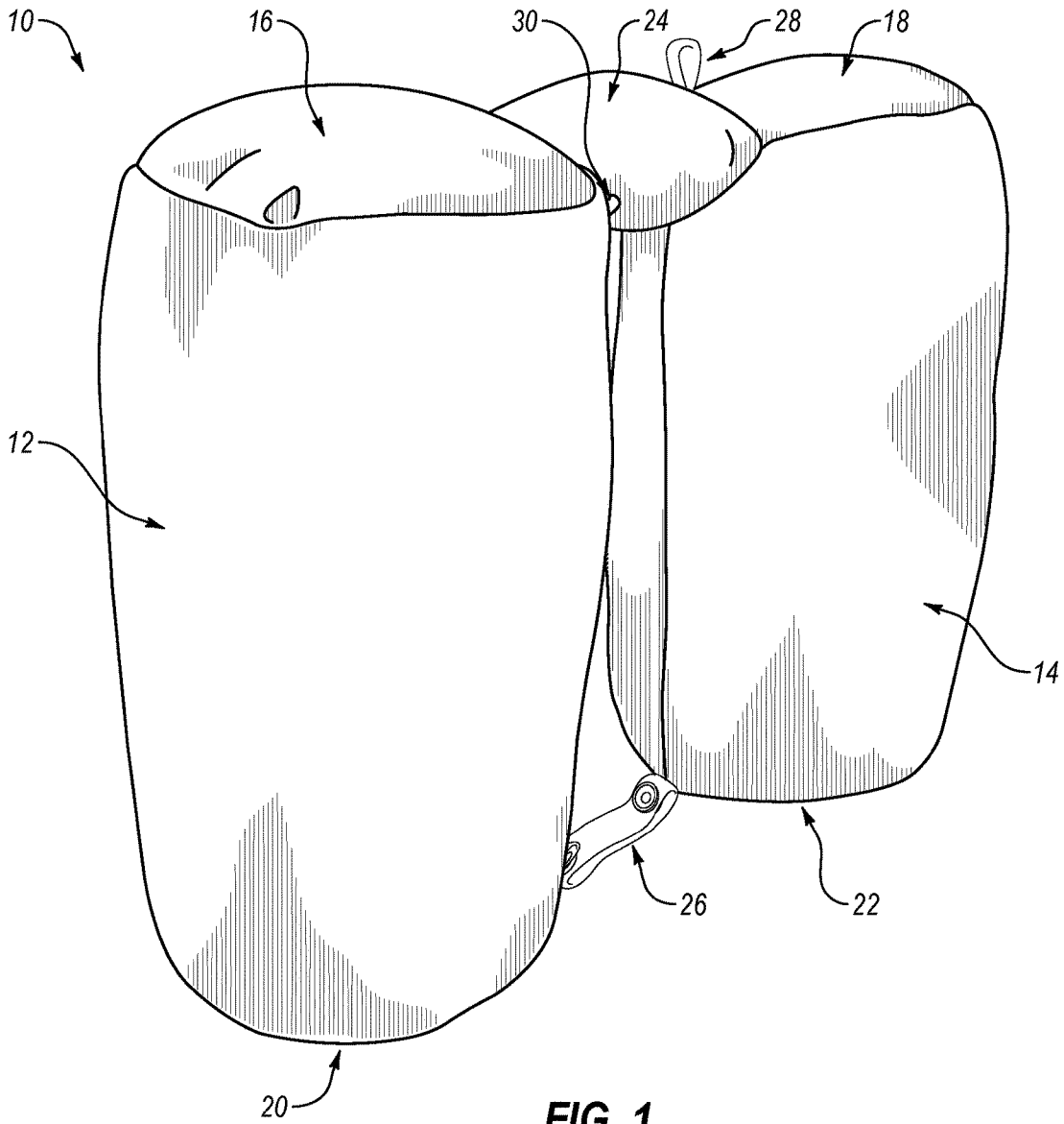
FIG. 1 is an upper perspective view of an exemplary embodiment of a pillow, illustrating the pillow in an exemplary configuration.
Figure 2:
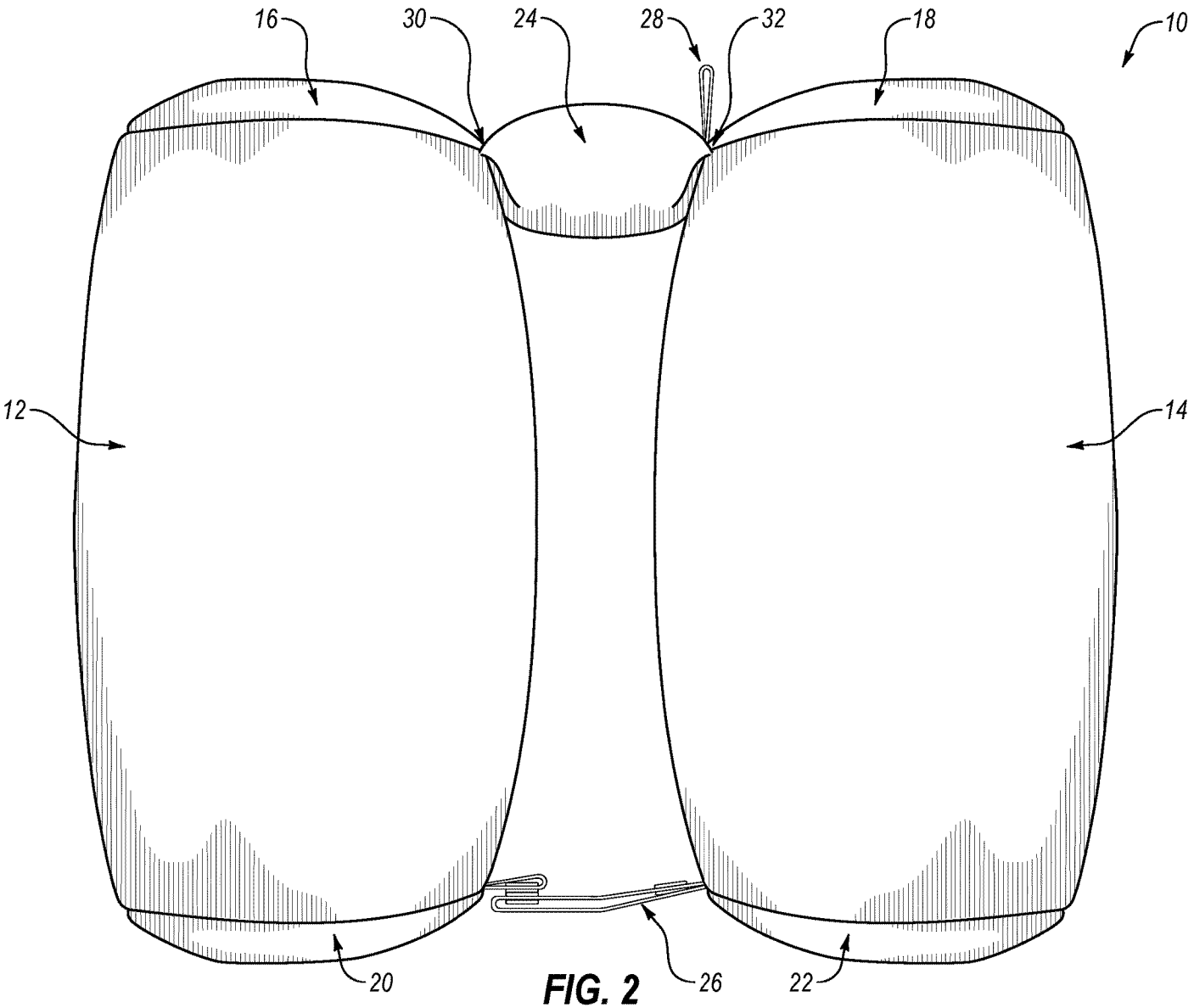
FIG. 2 is a top view of the pillow.
Figure 3:
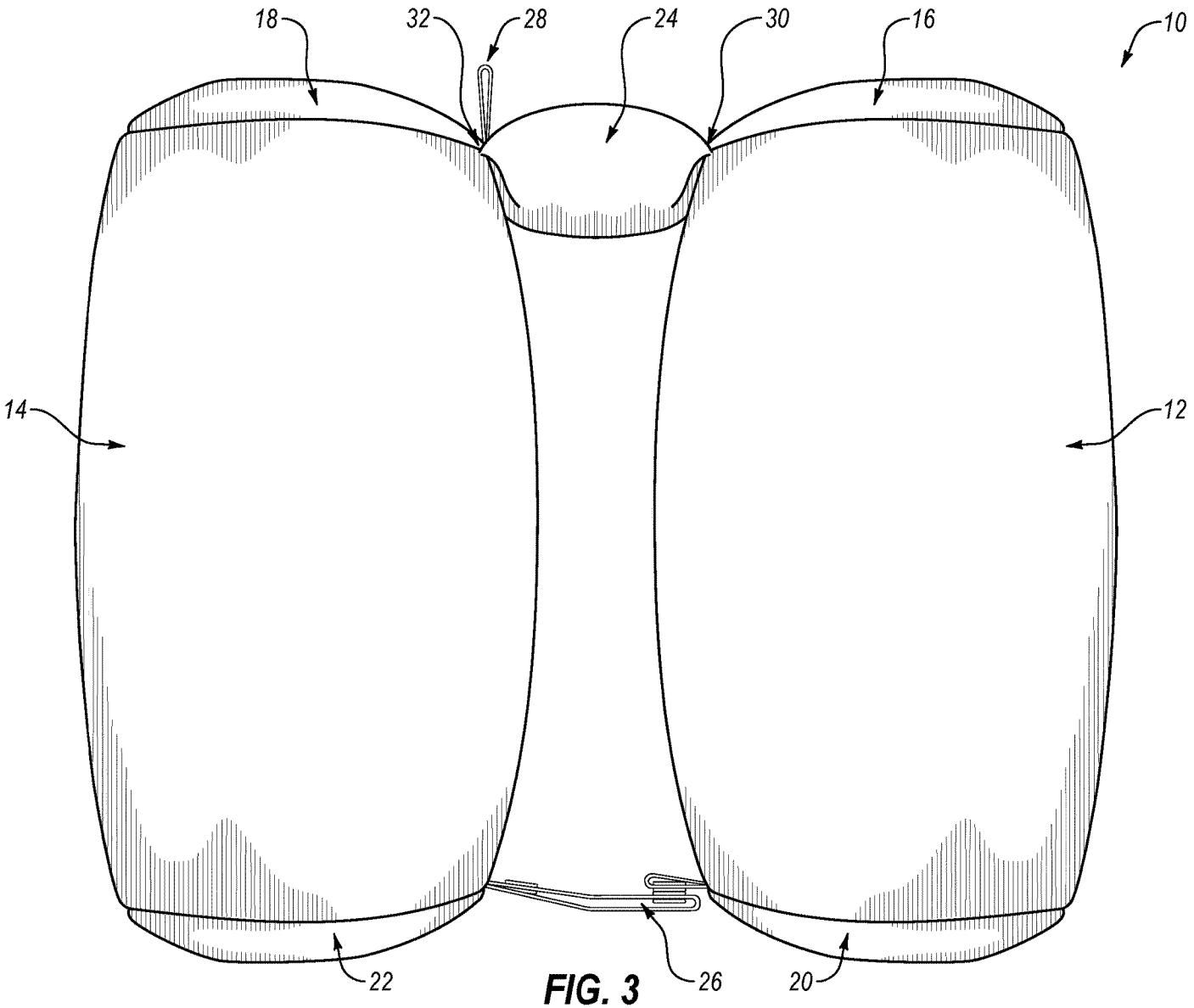
FIG. 3 is a bottom view of the pillow.
Figure 5:
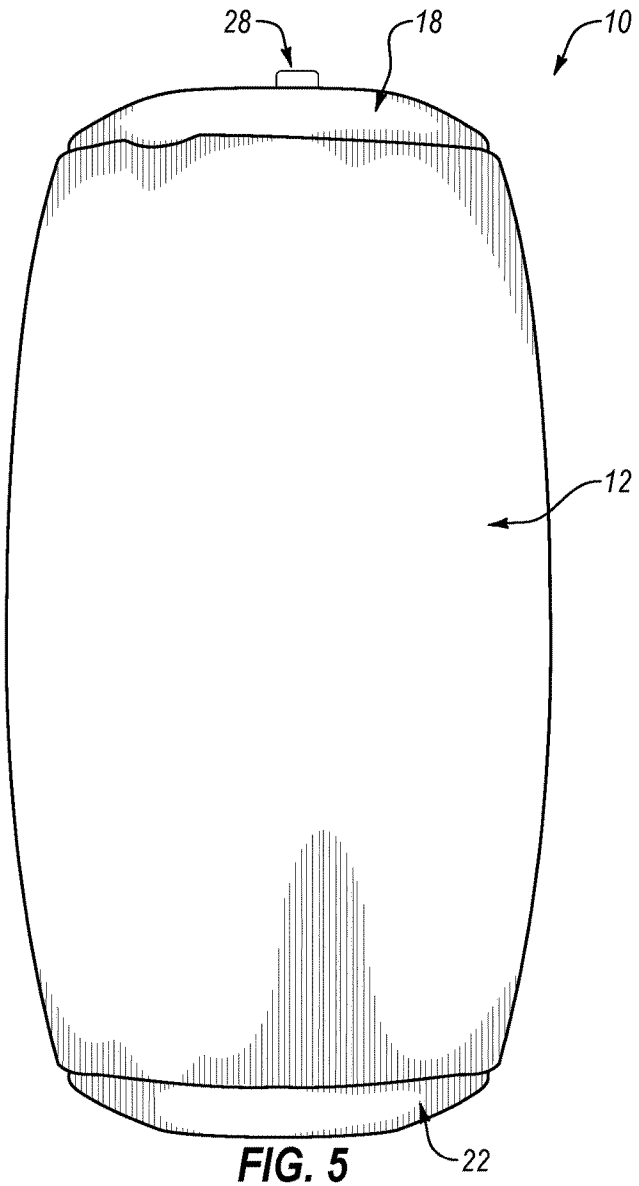
FIG. 5 is a right side view of the pillow.
Figure 4:
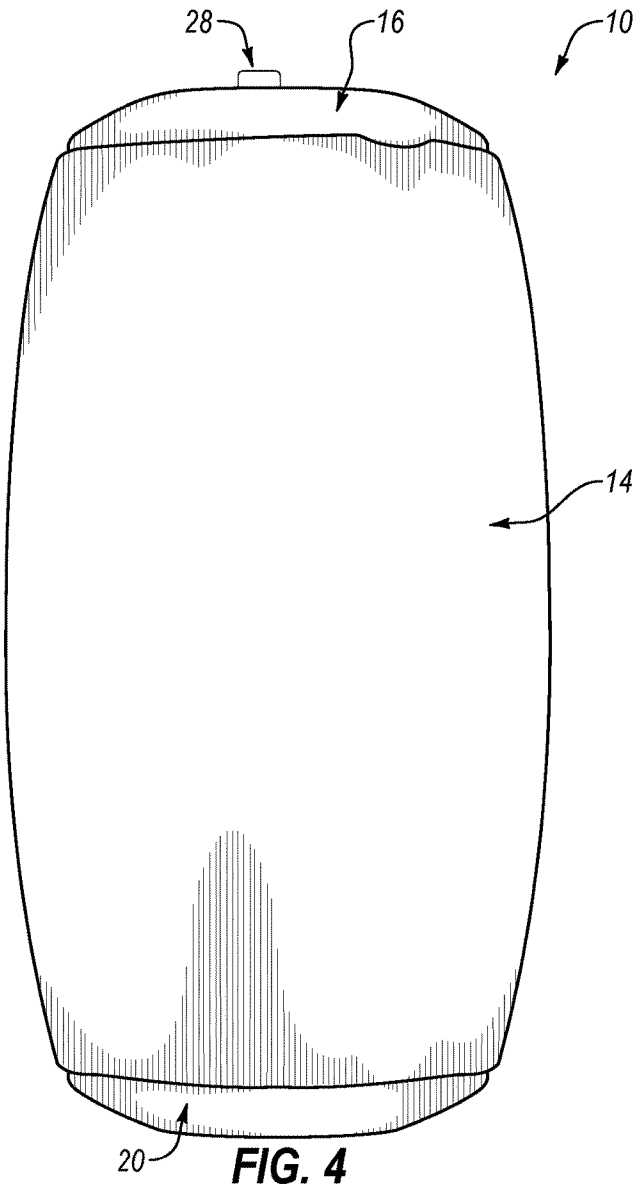
FIG. 4 is a left side view of the pillow.
Figure 6:
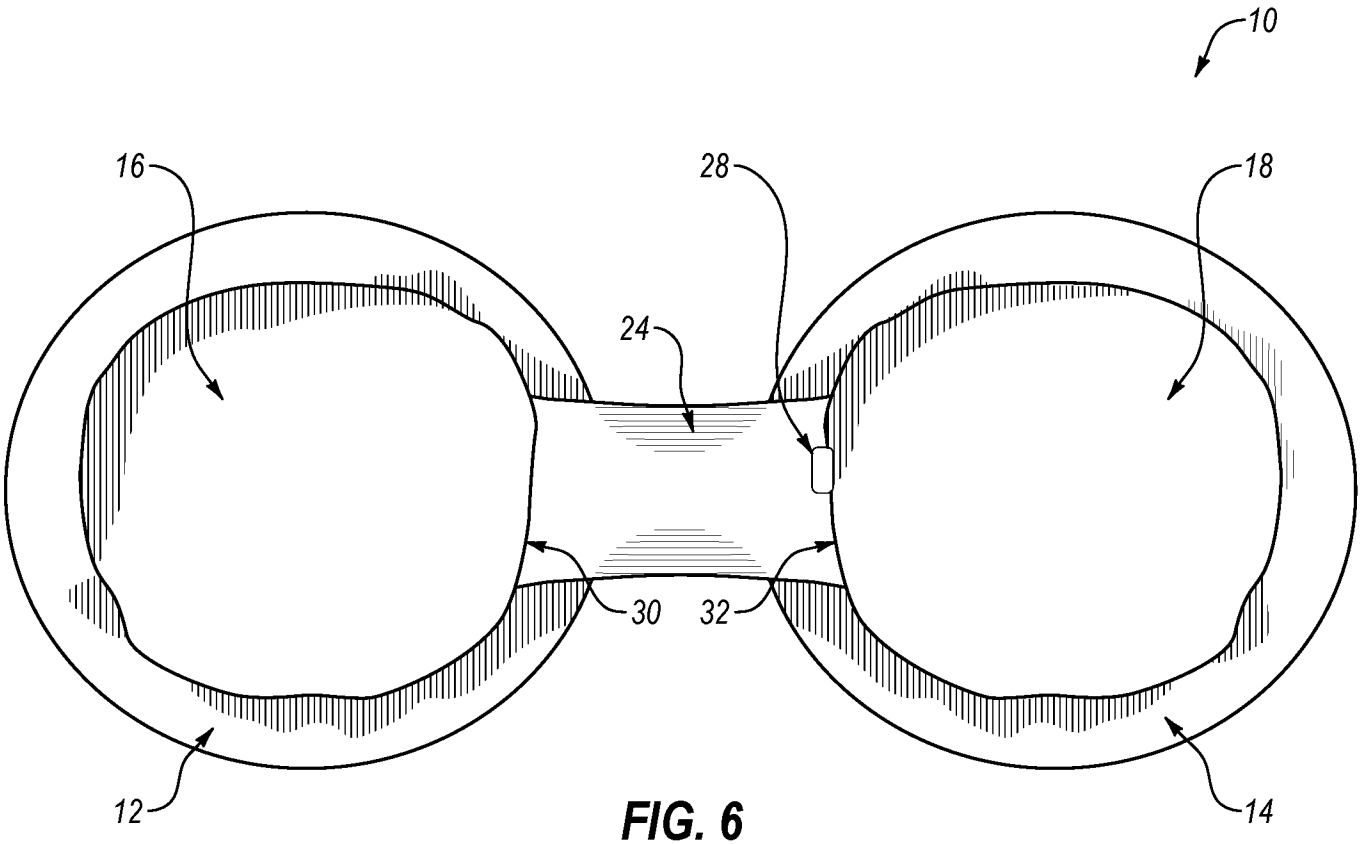
FIG. 6 is a rear view of the pillow.
Figure 7:
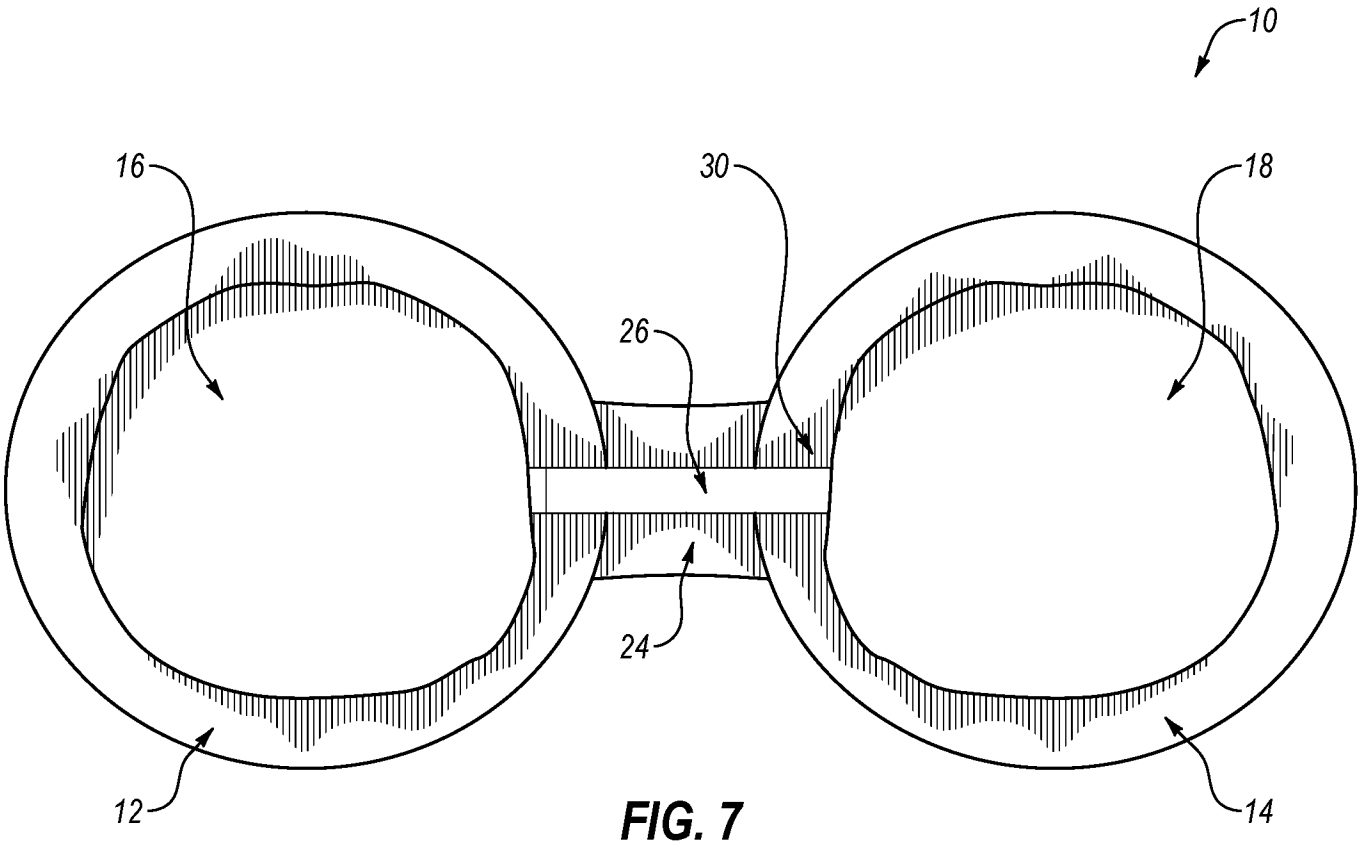
FIG. 7 is a front view of the pillow.
Figure 8:
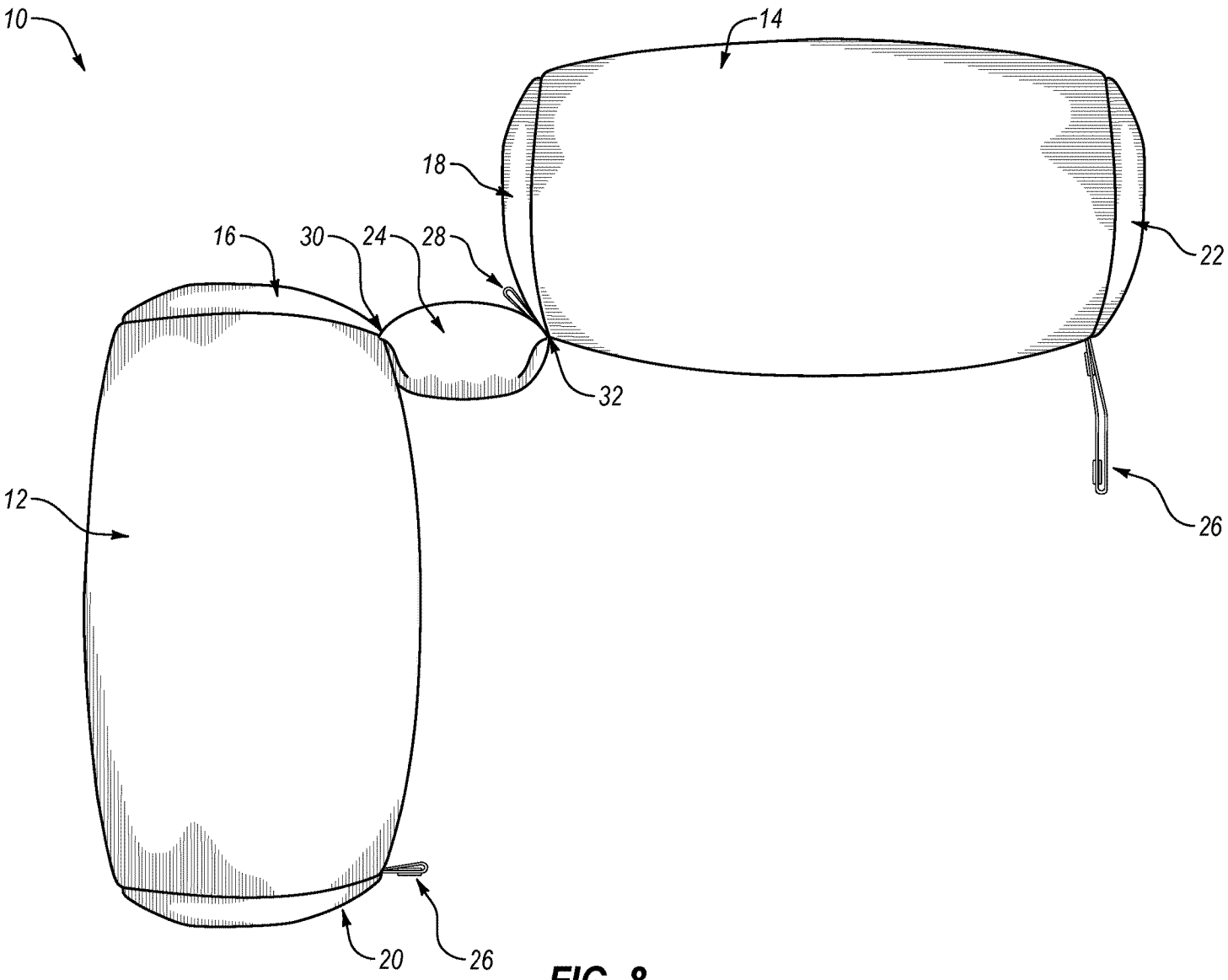
FIG. 8 is a top view of an exemplary embodiment of the pillow, illustrating the pillow in an exemplary configuration.
Figure 9:
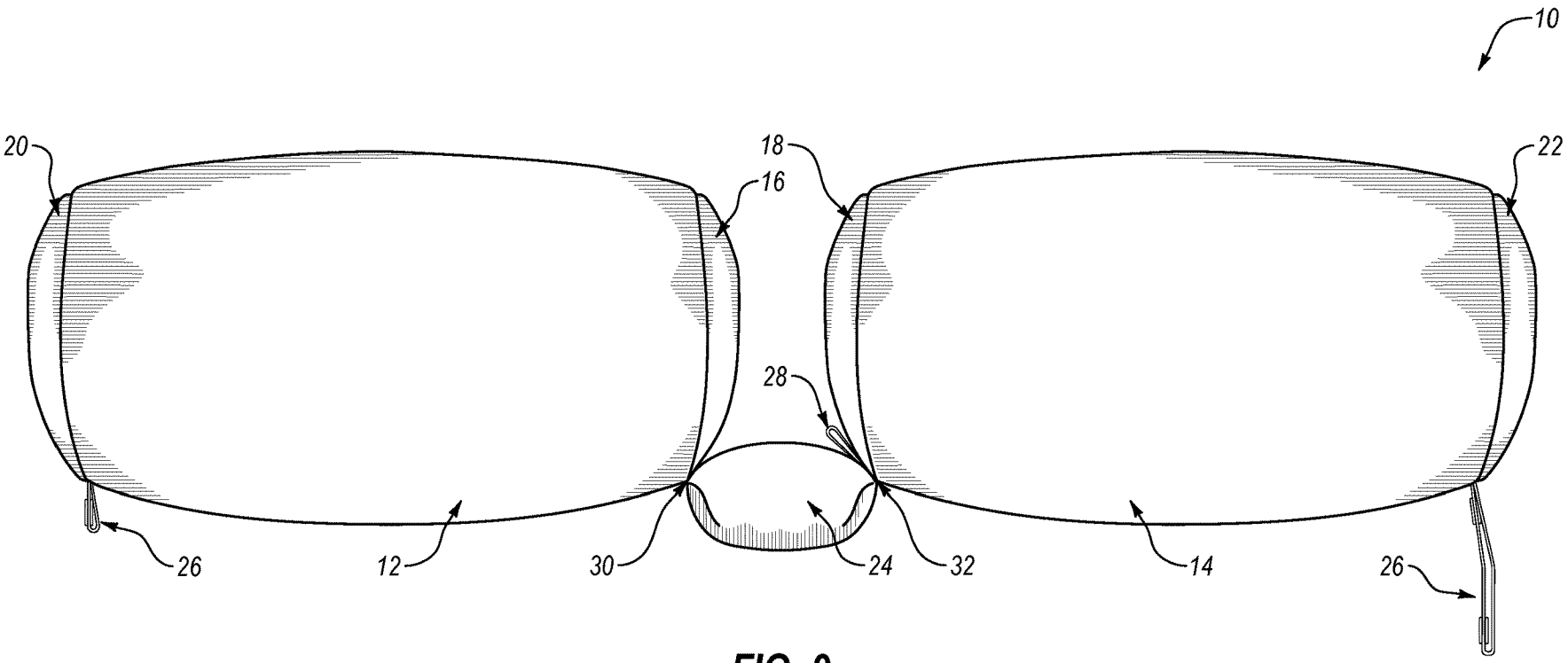
FIG. 9 is a top view of an exemplary embodiment of the pillow, illustrating the pillow in an exemplary configuration.
Figure 10:
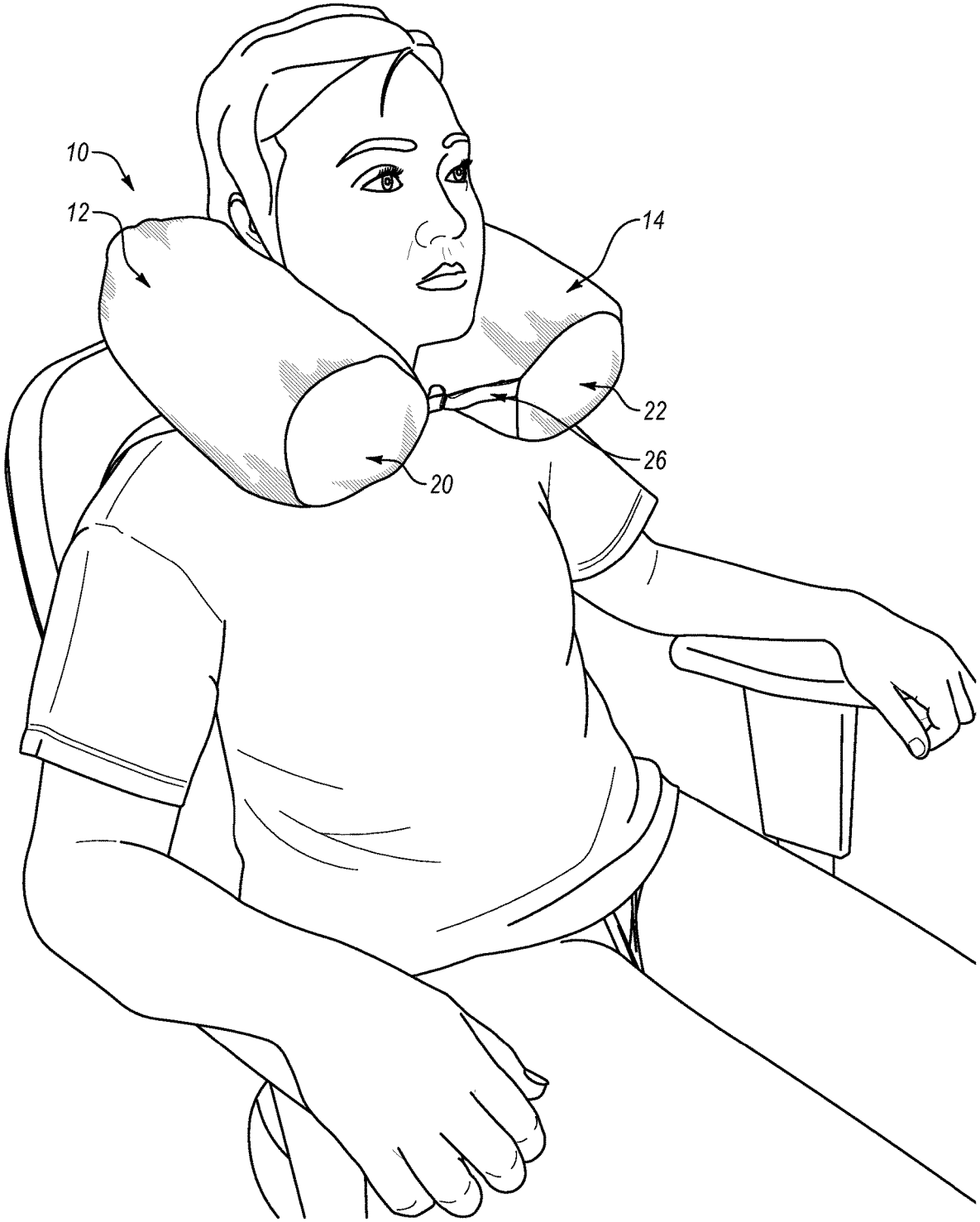
FIG. 10 is an upper perspective view of an exemplary embodiment of the pillow, illustrating the pillow in an exemplary configuration.
Figure 11:
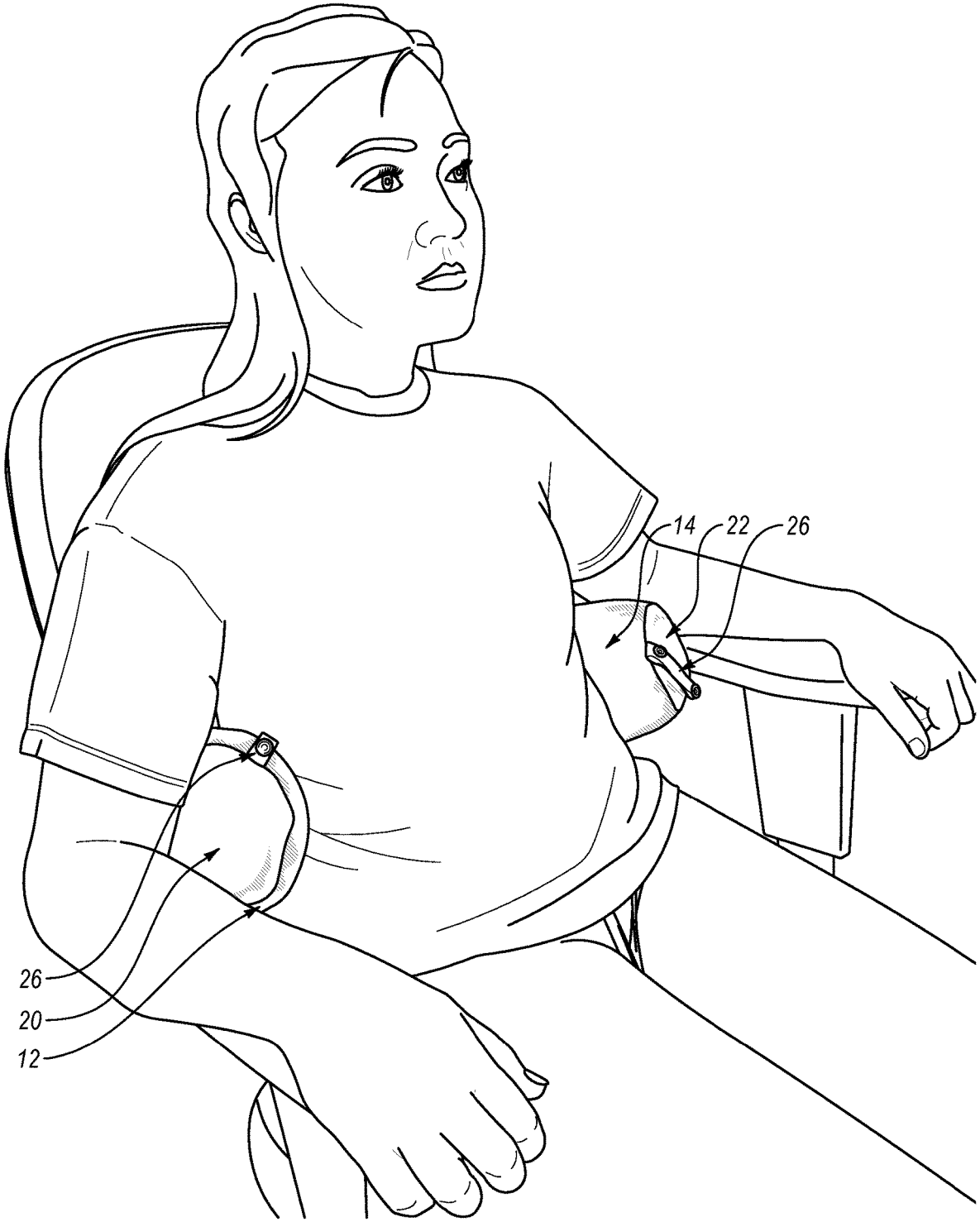
FIG. 11 is an upper perspective view of an exemplary embodiment of the pillow, illustrating the pillow in an exemplary configuration.

As shown in FIG. 1, an exemplary pillow 10 may include a first portion 12, such as a first arm, and a second portion 14, such as a second arm. The first arm 12 may include a proximal end 16 and the second arm 14 may include a proximal end 18. The first arm 12 may also include a distal end 20 and the second arm 14 may include a distal end 22.

The pillow 10 may include a third portion 24, such as a connecting portion. The connecting portion 24 may be connected to the first arm 12 and the second arm 14. In greater detail, the connecting portion 24 may be disposed between the first arm 12 and the second arm 14, and the connecting portion may form at least a portion of a medial region of the pillow 10. For example, the connecting portion 24 may be connected to the proximal end 16 of the first arm 12 and the proximal end 18 of the second arm 14. If desired, the connecting portion 24 may be generally aligned with the proximal end 16 of the first arm 12 and the proximal end 18 of the second arm 14. The connecting portion 24 may also be connected to other suitable portions of the pillow 10.

The pillow 10 may include a fastener or closure 26, which may be used to secure the pillow in a desired position and/or arrangement. The fastener 26 may be adjustable and that may increase the versatility of the pillow 10. For example, the fastener 26 may be adjustable in length. The fastener 26 may allow the pillow 10 to be used by people of different sizes and the fastener may allow the pillow to be adjusted as desired by the user. The fastener 26 may also allow the pillow 10 to be disposed in different configurations and/or arrangements. In an exemplary embodiment, the fastener 26 may be connected to the distal end 20 of the first arm 12 and the distal end 22 of the second arm 14. If desired, the fastener 26 may be generally aligned with distal end 20 of the first arm 12 and the distal end 22 of the second arm 14. The fastener 26 could also be connected to other suitable portions of the pillow 10.

In addition, the pillow 10 may include an outwardly extending portion 28 such as a connector, tab, loop, hanging component, or the like. The connector 28 may facilitate movement, use, and/or storage of the pillow. For example, the connector 28 may allow the pillow 10 to hang from a structure such as a hook.

As shown in the accompanying figures, an exemplary embodiment of the pillow 10 may include the first and second arms 12, 14 and the first and second arms 12, 14 may have a similar shape, size, configuration, and/or arrangement. For example, the first and second arms 12, 14 may have a generally cylindrical configuration with an outer diameter of about two (2) inches, about two and one-half (2.5) inches, about three (3) inches, about three and one-half (3.5) inches, about four (4) inches, or more. The first and second arms 12, 14 may have a length of about six (6) inches, about eight (8) inches, about ten (10) inches, about twelve (12) inches, or more. The ends of the first and second arms 12, 14 may be rounded or curved. The first and second arms 12, 14 may also have different shapes, sizes, configurations, and arrangements. For example, the first arm 12 and the second arm 14 may vary in length and one arm may be longer and/or have a different width, diameter, radius of curvature, configuration, arrangement, and the like than the other arm. Thus, it will be appreciated that the first arm 12 and the second arm 14 may vary in size, shape, configuration, and/or arrangement.

The first arm 12 and the second arm 14 may be filled or stuffed with a material that is sufficiently dense to support various body parts of a user, such as memory foam, cotton, microbeads, beanbag filler, foam, wool, feathers, polyester, polyester pellets, seeds, silk, or the like. The first and second arms 12, 14 may also have different densities depending, for example, upon the intended use of the pillow 10. The type and/or amount of material may allow the first and/or second portions of the pillow to generally maintain their shape during use. The type and/or amount of material may also allow the first and/or second portions of the pillow to deform and/or resiliently deform during use. One skilled in the art, after reviewing this disclosure, will appreciate that different types and/or amounts of material may be used depending, for example, upon the intended use of the pillow 10.

The first arm 12 and the second arm 14 may be movably connected by the connecting portion 24. For example, the first arm 12 may be movable relative to the second arm 14. In addition, the first arm 12 may be movably connected to the connecting portion 24 and the second arm 14 may be movably connected to the connecting portion 24.

Advantageously, the movable connections may allow the pillow 10 to be disposed in a variety of configurations. For example, the first arm 12, the second arm 14, and/or the connecting portion 24 may be generally aligned in a straight line, disposed in an angled position, or disposed in a generally U-shaped configuration.

In greater detail, the first arm 12 may be connected to the connecting portion 24 by a hinge-like feature 30 and the second arm 14 may also be attached to the connecting portion 24 by a hinge-like feature 32. Thus, the first arm 12 may pivot or rotate relative to the connecting portion 24 about a first axis of rotation and the second arm 14 may pivot or rotate relative to the connection portion 24 about a second axis of rotation. The first axis of rotation may be spaced apart from the second axis of rotation by a distance. In addition, the first axis of rotation and the second axis of rotation may be disposed in a generally parallel configuration.

As shown in the accompanying figures, the proximal end 16 of the first arm 12 and the proximal end 18 of the second arm 14 may have generally the same size and shape. In addition, the proximal end 16 of the first arm 12 and the proximal end 18 of the second arm 14 may be separated by the connecting portion 24. Additionally, when the pillow 10 is in the generally U-shaped configuration, the proximal end 16 of the first arm 12 and the proximal end 18 of the second arm 14 may be generally aligned and/or aligned in the same plane.

The distal end 20 of the first arm 12 and the distal end 22 of the second arm 14 may have generally the same size and shape. It will be appreciated that the distal end 20 of the first arm 12 and the distal end 22 of the second arm 14 may vary in shape or size. When the pillow 10 is in the generally U-shaped configuration, the proximal end 16 of the first arm 12 and the proximal end 18 of the second arm 14 may be generally aligned and/or disposed in the same plane.

The connecting portion 24 may be filled or stuffed with a material that is sufficiently dense to support and/or provide cushioning to a portion of the user, such as the back of the head or neck. The material may be memory foam, cotton, microbeads, beanbag filler, foam, wool, feathers, polyester, polyester pellets, seeds, silk, or the like. The type and/or amount of material may allow the connecting portion 24 to generally maintain its shape during use. The type and/or amount of material may also allow the connecting portion 24 to deform and/or resiliently deform during use. One skilled in the art, after reviewing this disclosure, will appreciate that different types and/or amounts of material may be used to make the connecting portion 24 depending, for example, upon the intended use of the pillow 10

The hinge-like features 30, 32 may allow one or more portions of the pillow 10 to fold, pivot, rotate, or bend. The hinge-like features 30, 32 may also allow the first arm 12 and the second arm 14 to move independently from one another. These hinge-like features 30, 32 may also allow the user to arrange the pillow 10 in a variety of positions in order to best support the user's various body parts.

The fastener 26 may include two or more parts or components. For example, a first part may be attached to the distal end 20 of the first arm 12 and a second part may be attached to the distal end 22 of the second arm 14. The first and second parts of the fastener 26 may be selectively connected. For example, the first and second parts of the fastener 26 may be connected by a buckle, snaps, hook and loop fasteners such as Velcro®, tying, hooks, buttons, pins, zippers, magnets, and the like. The fastener 26 may be adjustable in length, which may increase the versatility of the pillow 10.

The pillow 10 may be used to support the neck and/or head of a user sitting in a vertical, or near vertical position, while traveling or at home. Additionally, the pillow 10 may be used to support the neck and/or head of a user laying in a horizontal, or near horizontal position, while traveling or at home. The pillow 10, when used to support the neck and/or head of a user, may not force the neck and/or head in a forward or upward direction, which may significantly increase the comfort of the pillow 10. In particular, when the pillow 10 is in the generally U-shaped configuration and disposed about the neck and/or head of the user, the distal end 20 of the first arm 12, the distal end 22 of the second arm 14, and the connecting portion 24 may be generally aligned and/or disposed in a flush configuration. Because the thickness of the connecting portion 24 may be relatively small, such as two, three, four, five, or more times smaller than the diameter or thickness of the first arm 12 and/or the second arm 14, the connecting portion 24 may not push the user's head forwardly in the sitting position or upwardly in generally horizontal position.

Advantageously, the pillow 10 may be used for the support of various body parts for a user sitting in a vertical, or near vertical position while traveling or at home. The pillow 10 may additionally or alternatively be used to support various body parts of a user laying in a horizontal/near horizontal position, or vertical/near vertical position while traveling or at home. The pillow 10 may support body parts such as the feet, legs, back, and the like. For example, all or a portion of the pillow 10 may be positioned below one or both feet of the user, which may allow one or both feet to be elevated. In an exemplary embodiment, the pillow 10 may be placed between the legs of the user. In another exemplary embodiment, the pillow 10 may be placed behind the back of the user. After reviewing this disclosure, one skilled in the art will appreciate that the pillow 10 may support, provide cushioning, increase comfort, and the like. Additionally, after reviewing this disclosure, one skilled in the art will appreciate that the pillow 10 can be placed in various locations and/or in different configurations. For example, the pillow 10 may be placed in a generally parallel, angled, aligned, or other configuration depending, for example, upon the user and the pillow 10 may be positioned in a desired arrangement proximate the feet, legs, torso, arms, neck, and/or head of the user. Further, a user may use more than one pillow 10, if desired. For instance, a user may use one pillow 10 to support a first portion of the user's body and a second pillow 10 to support a second portion of the user's body.

Beneficially, two or more pillows 10 may be connected together, if desired. For example, the fastener 26 may allow multiple pillows 10 to be connected. This may increase the functionality and/or potential uses of the pillow 10.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A pillow comprising:

a first arm disposed in a generally cylindrical configuration, the first arm including a proximal end and a distal end, the first arm having a length measured between the proximal end and the distal end, the proximal end forming a base that is disposed generally perpendicular to an outer surface of the generally cylindrical first arm;

a second arm disposed in a generally cylindrical configuration, the second arm including a proximal end and a distal end, the second arm having a length measured between the proximal end and the distal end, the proximal end forming a base that is disposed generally perpendicular to an outer surface of the generally cylindrical second arm; and a connecting portion having a generally linear configuration with a first end attached at least proximate the connection of the base and the outer surface of the first arm and a second end attached at least proximate the connection of the base and the outer surface of the second arm, the connecting portion sized and configured to allow the first arm and second arm to move independently from one another, the connecting portion having a length measured between the connection to the first arm and the connection to the second arm, the length of the connecting portion being at least two times smaller than a length of the first arm or a length of the second arm, the connecting portion having a thickness or diameter at least two times smaller than a thickness or diameter of the first arm or a thickness or diameter of the second arm;

wherein the connecting portion is configured to not push a user's head upwardly when the user is in a generally horizontal or prone position; and wherein the connecting portion is configured to not push the head forwardly when the user is in a generally upright or sitting position.

2. The pillow of claim 1, wherein the thickness of the connecting portion is at least three times smaller than the diameter of the first arm or the diameter of the second arm.

3. The pillow of claim 1, wherein the length of the connecting portion is at least three times smaller than the length of the first arm or the length of the second arm.

4. The pillow of claim 1, wherein the first arm is rotatable relative to the connecting portion by at least ninety degrees; and wherein the second arm is rotatable relative to the connecting portion by at least ninety degrees.

5. The pillow of claim 1, wherein the connecting portion is aligned with the proximal end of the first arm when the pillow is in a generally U-shaped configuration; and wherein the connecting portion is aligned with the proximal end of the second arm when the pillow is in a generally U-shaped configuration.

6. The pillow of claim 1, wherein the thickness of the connecting portion is at least four times smaller than the diameter of the first arm or the diameter of the second arm.

7. The pillow of claim 1, wherein the length of the connecting portion is at least four times smaller than the length of the first arm or the length of the second arm.

8. The pillow of claim 1, wherein the thickness of the connecting portion is at least five times smaller than the diameter of the first arm or the diameter of the second arm.

9. The pillow of claim 1, wherein the length of the connecting portion is at least five times smaller than the length of the first arm or the length of the second arm.

10. The pillow of claim 1, wherein the first arm is rotatable relative to the connecting portion by at least forth-five degrees; and wherein the second arm is rotatable relative to the connecting portion by at least forth-five degrees.

11. A pillow comprising:

a first arm having a generally cylindrical configuration with a rounded outer surface and a base;

a second arm having a generally cylindrical configuration with a rounded outer surface and a base; and a connecting portion including a first end attached at least proximate a connection of the outer surface and the base of the first arm and a second end attached at least proximate a connection of the outer surface and the base of the second arm, the first arm movable relative to the connecting portion, the second arm movable relative to the connection portion, the connecting portion having a length at least two times smaller than a length of the first arm or a length of the second arm, the connecting portion having a thickness at least two times smaller than a diameter of the first arm or a diameter of the second arm;

wherein the first arm and the second arm are movable between a generally U-shaped configuration, an angled configuration, and a generally aligned configuration;

wherein the connecting portion is configured to not push a user's head upwardly when the user is in a generally horizontal or prone position; and wherein the connecting portion is configured to does not push the head forwardly when the user is in generally upright or sitting position.

12. The pillow of claim 11, wherein the length of the connecting portion is at least three times smaller than the length of the first arm or the length of the second arm.

13. The pillow of claim 11, wherein the thickness of the connecting portion is at least three times smaller than the diameter of the first arm or the diameter of the second arm.

14. The pillow of claim 11, wherein the length of the connecting portion is at least three times smaller than the length of the first arm or the length of the second arm; and wherein the thickness of the connecting portion is at least three times smaller than the diameter of the first arm or the diameter of the second arm.

15. The pillow of claim 11, wherein the first arm is rotatable relative to the connecting portion about a first axis;

wherein the second arm is rotatable relative to the connection portion about a second axis;

wherein the first axis is spaced apart from the second axis by a distance; and wherein the first axis is disposed generally parallel to the second axis.

16. The pillow of claim 11, wherein the first arm and the second arm are generally symmetrical.

17. The pillow of claim 11, wherein the first arm and the second arm are generally aligned along parallel axes when the first arm and the second arm are disposed in the generally U-shaped configuration.

18. The pillow of claim 11, wherein the first arm and the second arm are generally aligned along an axis when the first arm and the second arm are disposed in the generally aligned configuration.

19. The pillow of claim 11, wherein the thickness of the connecting portion is less than one-half a width of the first arm;

wherein the thickness of the connecting portion is less than one-half a width of the second arm;

wherein the length of the connecting portion is less than the width of the first arm; and wherein the length of the connecting portion is less than the width of the second arm.

20. The pillow of claim 11, wherein the connecting portion has a thickness less than one-half a radius of the first arm; and wherein the connecting portion has a thickness less than one-half a radius of the second arm.

* * * * *